US005353506A

United States Patent [19]

Müller et al.

[11] Patent Number: 5,353,506

[45] Date of Patent: Oct. 11, 1994

[54] MOTOR-DRIVEN CHAIN SAW HAVING A GUIDE BAR

[75] Inventors: Wilfried Müller, Rudersberg; Helmut Zimmermann, Kernen, both of Fed. Rep. of Germany

[73] Assignee: Andreas Stihl, Waiblingen, Fed. Rep. of Germany

[21] Appl. No.: 996,076

[22] Filed: Dec. 23, 1992

[30] Foreign Application Priority Data

Dec. 23, 1991 [DE] Fed. Rep. of Germany ..... 4142751

[51] Int. Cl.[5] ..... B27B 17/02

[52] U.S. Cl. ..... 30/386; 30/383

[58] Field of Search ..... 30/383–387

[56] References Cited

U.S. PATENT DOCUMENTS

| | | | |
|---|---|---|---|
| 3,636,995 | 1/1972 | Newman | 30/386 |
| 4,567,658 | 2/1986 | Wissmann et al. | 30/386 |
| 4,999,918 | 3/1991 | Schliemann et al. | 30/386 |

*Primary Examiner*—Richard K. Seidel
*Assistant Examiner*—Hwei-Siu Pater
*Attorney, Agent, or Firm*—Walter Ottesen

[57] ABSTRACT

The invention is directed to a motor-driven chain saw having a drive motor arranged in a housing. The drive motor drives a saw chain on a guide bar via a sprocket wheel. The guide bar extends forwardly in the longitudinal direction of the chain saw and has an elongated slot in its rearward end facing toward the housing. Stud bolts fixed on the housing extend through the elongated slot in a direction transverse to the longitudinal direction of the chain saw. The rearward end of the guide bar is clamped between the housing and a sprocket-wheel cover through which the stud bolts extend. A holding device separate from the sprocket-wheel cover is provided at the rearward end of the guide bar for holding the rearward end of the guide bar in its position on the housing when the sprocket-wheel cover is removed. This holding device reliably holds the guide bar for mounting the saw chain.

25 Claims, 15 Drawing Sheets

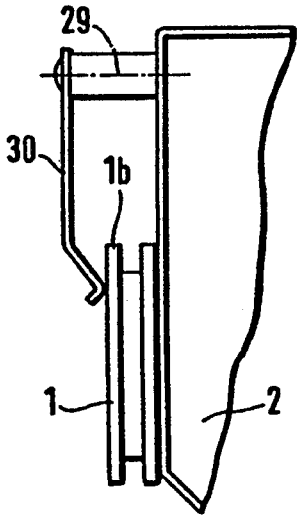
Fig. 14
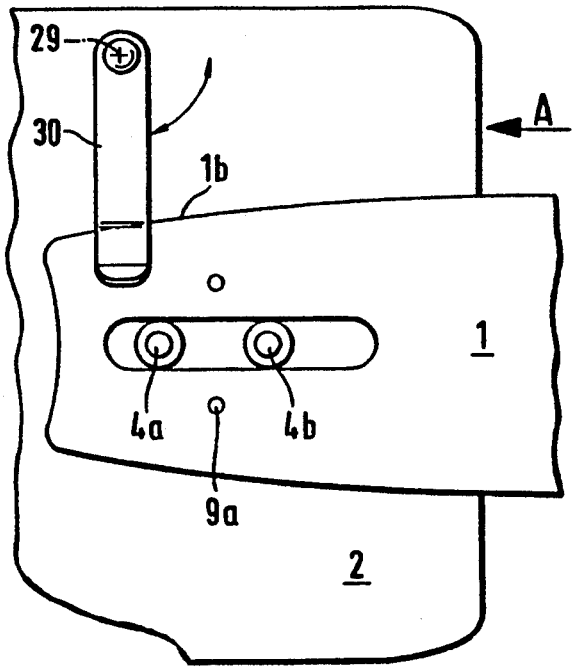
Fig. 13
Fig. 15
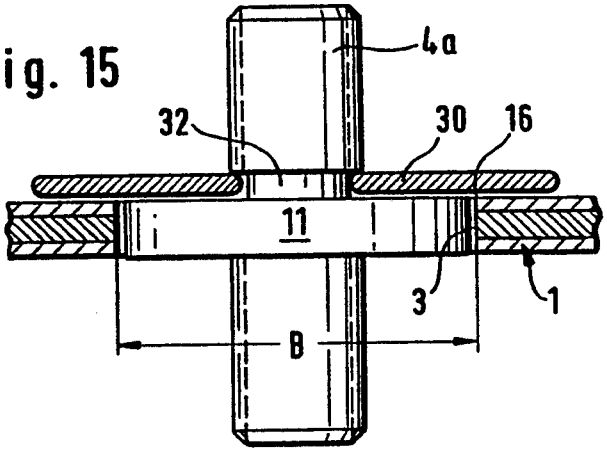
Fig. 16
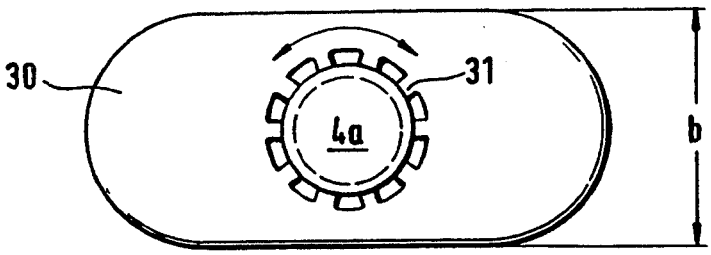

MOTOR-DRIVEN CHAIN SAW HAVING A GUIDE BAR

BACKGROUND OF THE INVENTION

Motor-driven chain saws are known wherein the guide bar is mounted between the sprocket-wheel cover and the housing. For this purpose, stud bolts fixed on the housing extend through the guide bar and the sprocket-wheel cover and attachment nuts threadably engage the stud bolts at their free ends. When a saw chain is exchanged, the sprocket-wheel cover must be removed since the saw chain must be fitted into the guide groove of the guide bar as well as over the sprocket wheel for driving the saw chain. For this operation, the motor-driven chain saw lies on its side with the guide bar lying loosely on the side of the housing. The threaded bolts extend through the attachment protection of the guide bar. The guide bar can tip over the forward housing edge because of the projecting length thereof. The user must therefore support the forward end which, however, is difficult at the job site and is often not possible. The difficulty is always present that the guide bar will tip over because the operator needs both hands for mounting the saw chain whereby the exchange of the saw chain is made very difficult.

SUMMARY OF THE INVENTION

It is an object of the invention to provide a motor-driven chain saw equipped with a sprocket-wheel cover for clamping the guide bar wherein the guide bar is prevented from tipping over when the sprocket-wheel cover is removed for mounting a saw chain.

The motor-driven chain saw of the invention defines a longitudinal axis and is equipped with a saw chain and a drive motor for driving the saw chain via a sprocket wheel. The motor-driven chain saw includes: a housing for accommodating the drive motor therein; a guide bar having a guide groove for guiding the saw chain; the guide bar having a rearward end facing toward the housing where the guide bar is mounted on the housing so as to extend forwardly from the housing in the direction of the axis; the guide bar having an elongated slot formed in the rearward end; at least one threaded bolt fixedly mounted on the housing and extending through the elongated slot transversely to the axis when the guide bar is mounted on the housing; a sprocket-wheel cover for covering the sprocket wheel; threaded clamping means for threadably engaging the threaded bolt for clamping the rearward end of the guide bar between the housing and the cover; the guide bar having a predetermined position on the housing when mounted and held on the housing; a holding device for holding the rearward end in the predetermined position on the housing when the cover is removed; and, the holding device being separate from the cover.

The holding device is fixed to the housing and is configured separately from the sprocket-wheel cover. In this way, the guide bar is caused to remain in its position even when the sprocket-wheel cover is removed so that a new saw chain can be mounted without the guide bar tipping over. It is here to be noted that the holding device provided by the invention does not restrict the configuration of the guide bar and must not be disassembled for removing the guide bar.

An advantageous embodiment of the holding device includes a latching member which is resilient and configured as a spring bracket having a circular configuration. Such a latching member is seated in a peripheral slot of a collar of the stud bolt and lies approximately parallel to the plane of the guide bar so that a motor-driven chain saw which has already been placed in the marketplace can be conveniently retrofitted by an exchange of the stud bolts. The collars of the stud bolts are disposed in the elongated slot when the guide bar is axially seated. A latching groove is provided in the surface defining the elongated slot for latching the spring bracket.

In another embodiment of the invention, the stud bolts carry a latching member rotatable by 90° into a latch position. The latching member engages over the guide bar on the side thereof facing away from the housing.

BRIEF DESCRIPTION OF THE DRAWINGS

The invention will now be described with reference to the drawings wherein:

FIG. 13 is a schematic of a holding device having a pivotable latching member;

FIG. 14 is a view of the holding device viewed in the direction of arrow A of FIG. 13;

FIG. 15 is a section view taken through a stud bolt having a rotatable latching member;

FIG. 16 is a plan view of the stud bolt of FIG. 15;

DESCRIPTION OF THE PREFERRED EMBODIMENTS OF THE INVENTION

Figure 1:
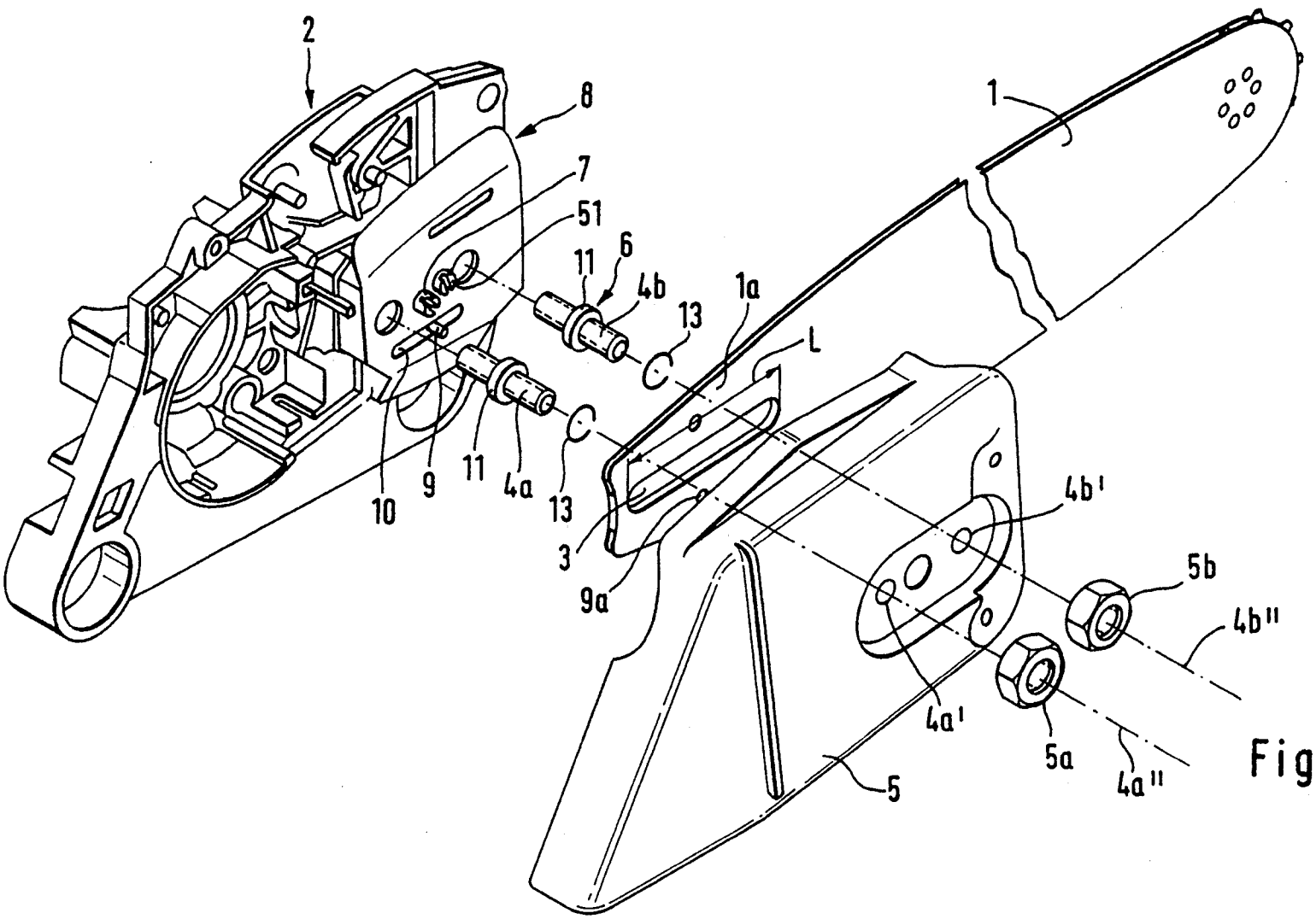
FIG. 1 is an exploded view of a part of the housing of a motor-driven chain saw equipped with a sprocket-wheel cover for clamping a guide bar.

FIG. 1 shows the arrangement of a guide bar 1 on the housing 2 of a motor-driven chain saw. A side wall 8 is attached to the housing 2 for protecting the housing 2 which surrounds the drive motor. The housing 2 is in most cases made of plastic, magnesium or a similar light metal. The adjusting screw 7 of a saw-chain tensioning device extends outwardly from the side wall 8 with the tensioning device being integrated in the housing 2. An adjusting pin 9 is moved in the longitudinal direction of the motor-driven chain saw along the slot 10 when the adjusting screw 7 is rotated. Two threaded bolts (stud bolts) 4*a* and 4*b* are screwed into the housing 2 through the two openings in the side wall 8. Each stud bolt 4*a* and 4*b* has a center collar 11. The collar 11 is in contact engagement with the housing 2. The side wall 8 is connected to the housing 2 via a screw 51.

The guide bar 1 extends in the longitudinal direction of the housing and has a rearward end 1*a* facing toward the housing 2. The end 1*a* facing toward the housing 2 is seated on the side wall 8 with the stud bolts 4*a* and 4*b* being disposed in an elongated slot 3 with their respective collars 11. The elongated slot 3 extends in the longitudinal direction of the guide bar 1 and is provided at the rearward end 1*a* thereof. The adjusting pin 9 of the saw-chain tensioning device engages in an access opening 9*a* of the guide bar 1.

Figure 2:
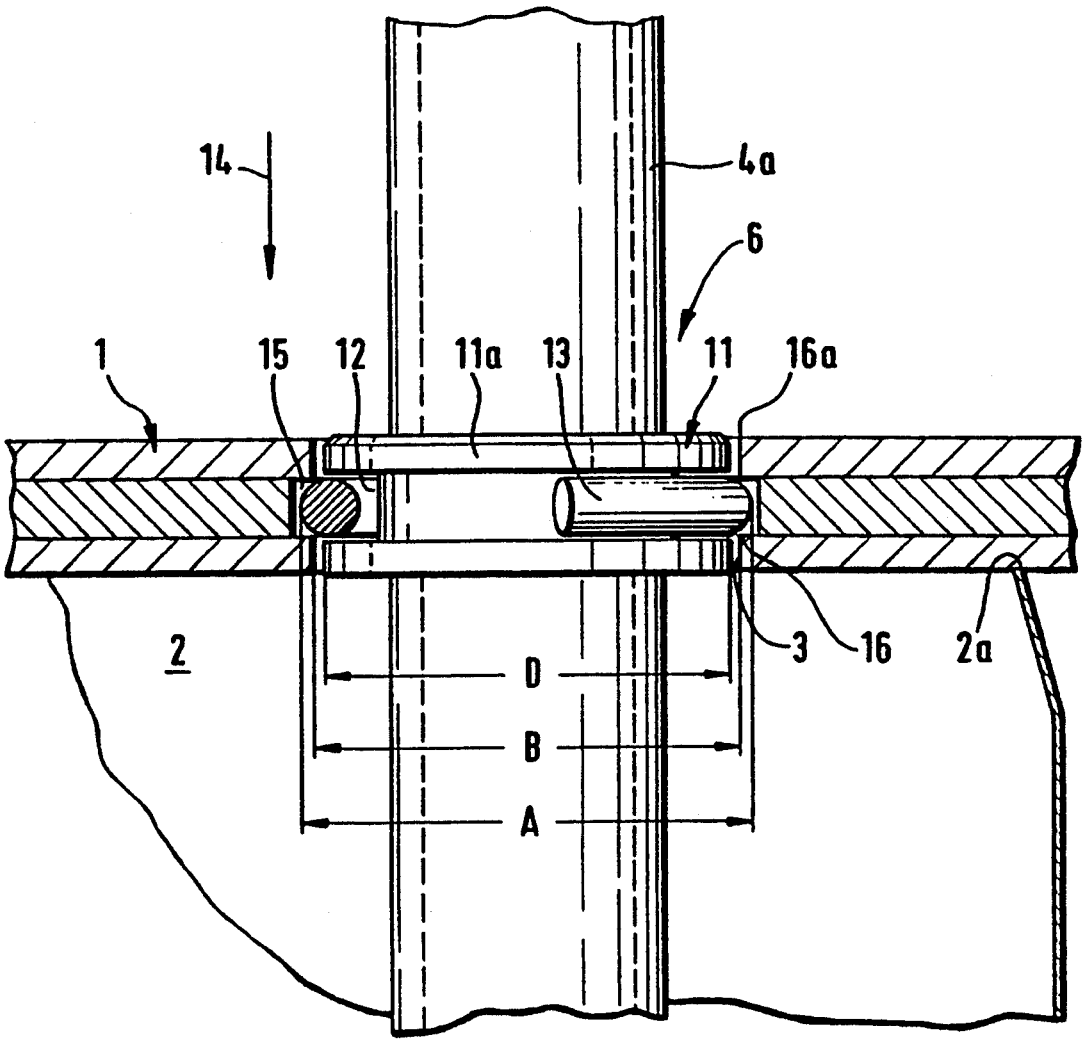
FIG. 2 is an enlarged detail view showing a section taken through a stud bolt with the guide bar in place.

As shown in FIG. 2, a spring bracket 13 is disposed in a peripheral groove 12 of the collar 11. In the embodiment shown, the spring bracket 13 is configured as a split spring ring having a circularly-shaped cross section and is part of a holding device 6 fixed to the housing and separate from the sprocket-wheel cover 5.

The elongated slot 3 of the guide bar has a width B which is slightly greater than the diameter D of the collar 11. The spring ring 13 lies in the peripheral groove 12 and has an outer diameter A which is greater than the width B of the elongated slot 3. The peripheral groove 12 has a depth selected so that the spring ring 13 can be pressed together by the inner edge 16 of the elongated slot 3 up to the width B of the elongated slot 3 when the guide bar 1 is placed in position in the direction of arrow 14. In this way, the collar 11 enters into the elongated slot 3. A latching groove 15 is provided in the inner surface of the guide bar defining the elongated slot 3 and this latching groove 15 is preferably configured as a peripheral groove 15 into which the ring 13 enters and where the ring 13 can become relaxed (unstressed) by expansion. In this way, the guide bar is fixed in a form-tight manner on the collar 11 because the relaxed spring ring 13 engages over the inner edge 16 of the elongated slot 3. The guide bar 1 is held in its position on the housing 2 without the sprocket-wheel cover 5 (FIG. 1) so that the guide bar 1 cannot tilt downwardly over the forward housing edge 2*a*. The saw chain can easily be placed in position in order to then seat the sprocket-wheel cover 5 on the stud bolts 4*a* and 4*b* which then extend through openings 4*a*' and 4*b*', respectively. The cover 5 then can be fixed to the housing 2 transversely to the longitudinal direction of the motor-driven chain saw by screwing tight attachment nuts (5*a*, 5*b*) (FIG. 1). The guide bar is then fixed between the sprocket-wheel cover 5 and the housing 2.

A two-part embodiment of the collar 11 is advantageous for assembling the spring ring 13 in the peripheral groove 12 of the collar 11. The upper section of the collar 11 can be configured as a threadably-mountable plate 11*a*. The peripheral groove 12 for receiving the split spring ring 13 is at first open in the axial direction. After seating the spring ring 13, the plate 11*a* is threadably engaged and thereby the spring ring 13 is axially held so that it cannot become lost.

Figure 3:
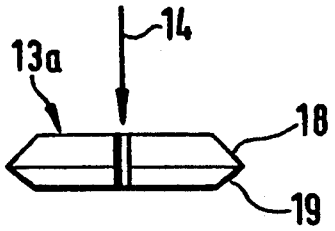
FIG. 3 is a view of a spring ring having a cross section departing from the circular form.
Figure 4:
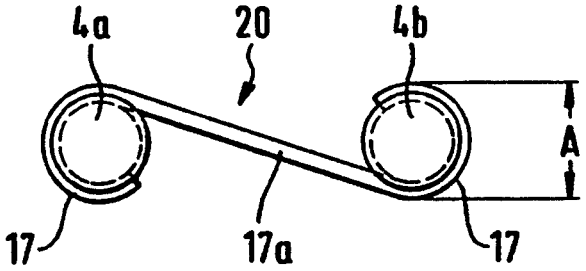
FIG. 4 is a plan view of two stud bolts fixed to the housing and an S-shaped spring bracket.

The spring ring 13*a* shown in FIG. 3 has a cross-sectional shape which departs from the circular shape. The outer surface has essentially two inclined surfaces (18, 19) with the inclined surface 18 having a slope less than the surface 19. The surface 18 faces toward the direction of arrow 14 and the surface 19 faces in the direction of arrow 14. The embodiment of a spring ring, which is corrugated in the peripheral direction, is also advantageous. Because of its shape, this spring ring is held substantially centered in the peripheral groove 12 on the stud bolts 4*a* and 4*b*.

A collar 11 configured as a holding device 6 is adequate for holding the guide bar 2. In the embodiment of FIG. 1, both stud bolts 4*a* and 4*b* carry a spring ring 13 in a peripheral groove of a collar 11. In lieu of the two spring rings 13, it can also be advantageous to provide a spring bracket 20 bent to have an S-shape with the spring bracket 20 being carried in common by both bolts 4*a* and 4*b*. The ends of the spring bracket 20 engage over the bolts with arcs 17 preferably over approximately 270° and the intermediate piece 17*a* extends preferably diagonally between the bolts 4*a* and 4*b* with the intermediate piece 17*a* connecting the arcs 17. In this embodiment, the maximum outer diameter A of the arc 17 is also dimensioned so that it lies relaxed in the latching groove 15 of the guide bar 1.

Figure 5:
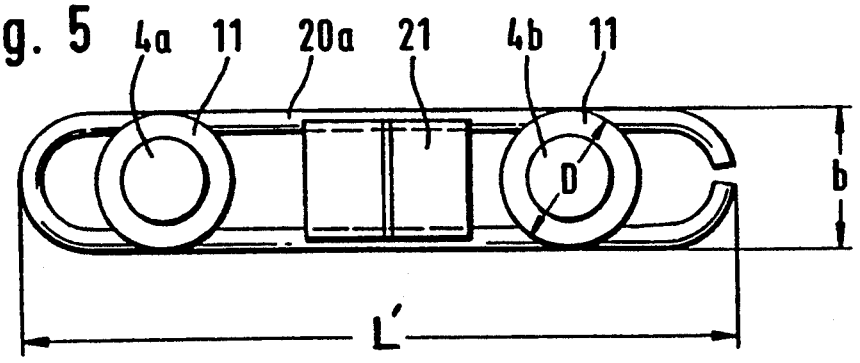
FIG. 5 is a plan view of two stud bolts fixed to the housing and a spring bracket having an elongated O-shape.

The spring bracket 20*a* shown in FIG. 5 as an approximately U-shaped base form with the free leg ends being bent toward each other in a circular shape. The form is therefore similar to a slit O. The spring bracket is held in the peripheral grooves of the collars 11.

Figure 6:
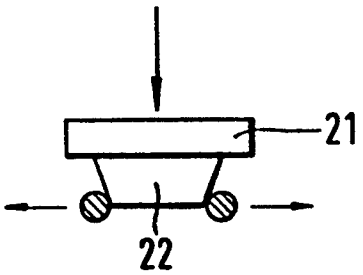
FIG. 6 is a schematic view showing how the spring bracket of FIG. 5 is widened.

As shown in the plan view of FIG. 5, the width (b) of the relaxed spring bracket 20*a* is not greater than the diameter D of the bearing collar 11 of a stud bolt 4*a* or 4*b*. The length L' of the spring bracket 20*a* is less than the length L of the slot 3 (FIG. 1). The guide bar can then be placed axially on the stud bolts 4*a* and 4*b* without the application of force with the spring bracket 20*a* coming to rest in the longitudinal groove 3 in the plane of the latching groove 15. A spread element 21 configured as a rocker is arranged in the spring bracket 20*a* between the two stud bolts 4*a* and 4*b*. As shown in FIG. 6, the spread element 21 widens the spring bracket 20*a* when pressed down over a spread wedge 22 whereby the spring bracket 20*a* enters into the latching groove 15 of the guide bar 1 or, alternatively, becomes latched over the guide bar and holds the guide bar on the housing 2 of the chain saw so that the guide bar cannot be lost. The spread element 21 can be latched in the spread position of the spring bracket 20*a*.

Figure 7:
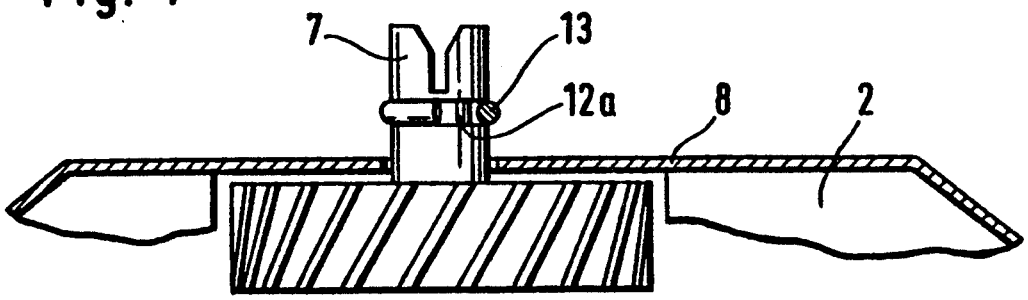
FIG. 7 is a detail view of the saw-chain tensioning device shown in FIG. 1 which is provided with an extended adjusting screw.

FIG. 7 is a schematic section view which shows a portion of the saw-chain tensioning device in the housing 2 of the motor-driven chain saw. The adjusting screw 7 projects outwardly beyond the side wall 8 and carries the spring ring 13 in a peripheral groove 12*a* in correspondence to the stud bolt of FIG. 2. The outer diameter of the spring ring 13 is greater than the width B of the elongated slot 3. As shown in FIG. 1, the adjusting screw 7 projects into the elongated slot 3 so that the spring ring 13 can enter the latching groove 15 and the guide bar 1 becomes latched in its position on the housing 2.

In lieu of the adjusting screw 7, the adjusting pin 9 can also carry a spring ring 13 or like latching member in order to coact with an inner latching groove in the access opening 9*a*.

Figure 8:
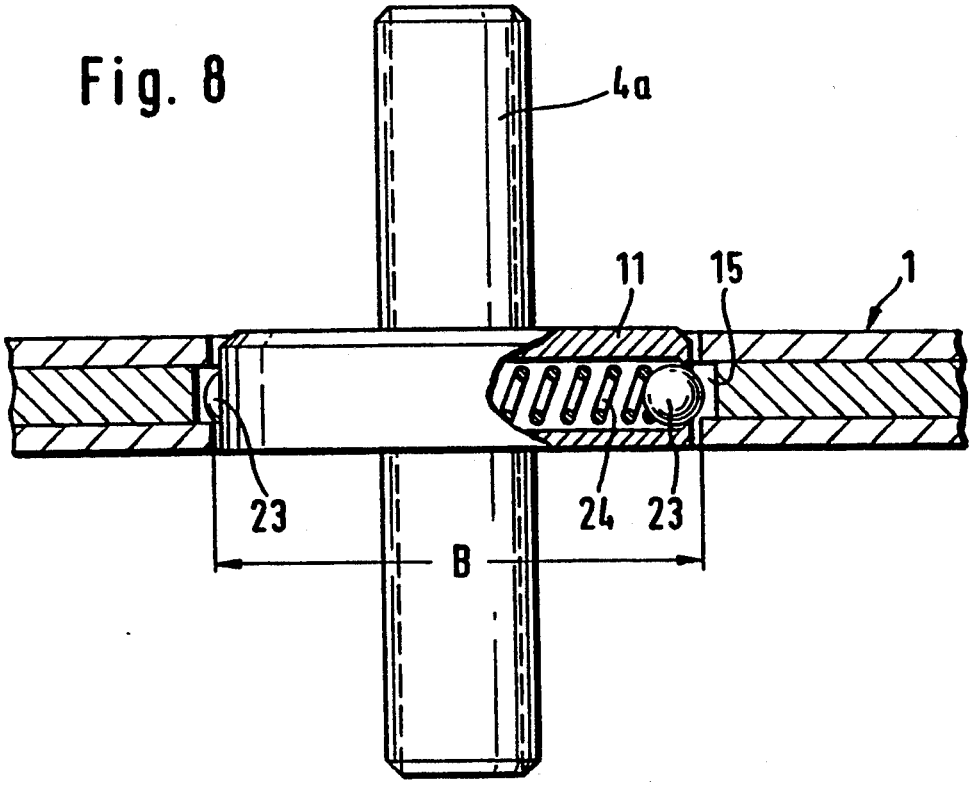
FIG. 8 is another embodiment of a holding device configured in the collar of a threaded bolt fixed to the housing.

In the embodiment of FIG. 8, latching balls 23 are journalled in the collar 11 of the stud bolt 4*a* with force being applied to the latching balls 23 by a spring 24 into the latching position. The latching balls 23 are advantageously disposed in a bore extending in the direction of the width B of the elongated slot 3 with the bore also accommodating the spring 24. The bore is advantageously a through bore so that the spring 24 applies force to a latching ball 23 at both ends of the bore. As described above with respect to the spring ring 13, the latching balls engage in the latching groove 15 in the elongated slot 3 of the guide bar 1 and therefore fixedly position the guide bar 1 on the housing 2 without the necessity of mounting the sprocket-wheel cover 5.

Figure 9:
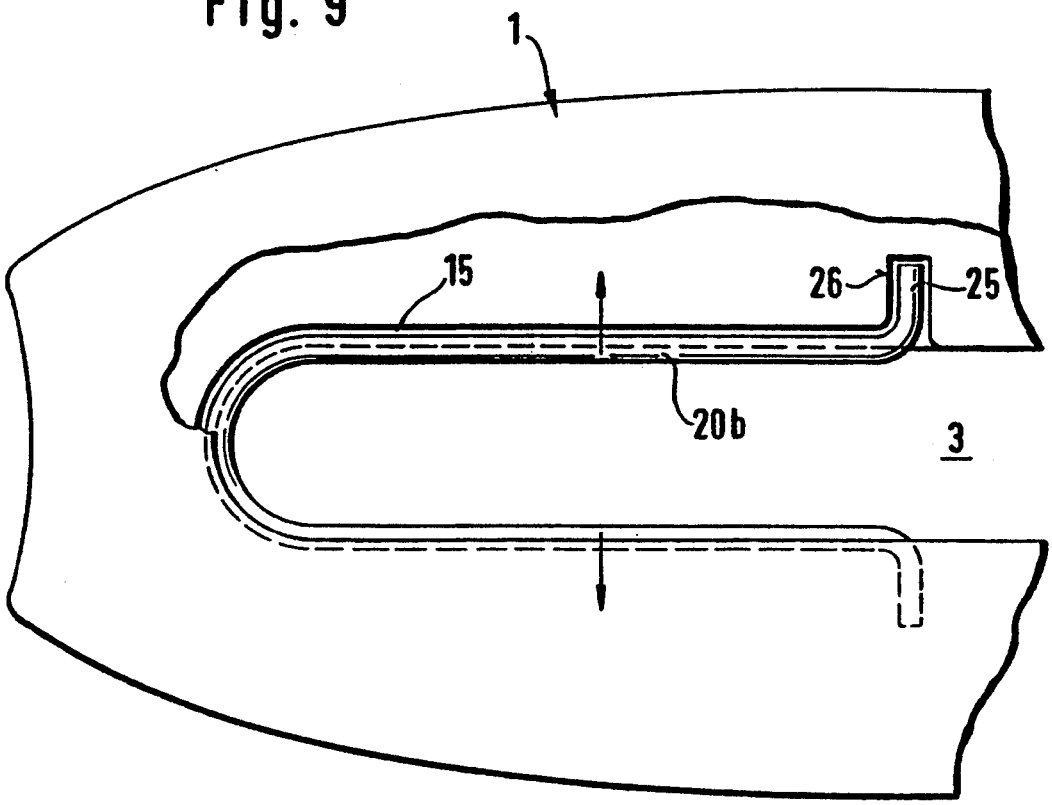
FIG. 9 is a plan view of a spring bracket held in an elongated slot of the guide bar.
Figure 10:
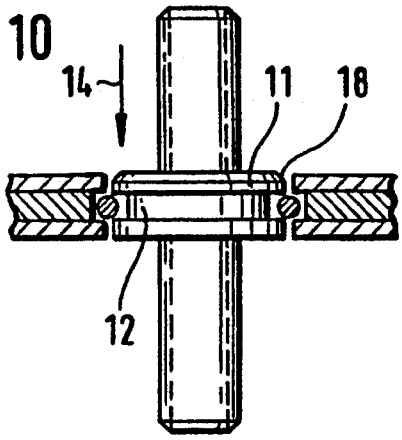
FIG. 10 is a section view of the guide bar of FIG. 9 seated on a stud bolt having a collar.

In the embodiment of FIGS. 9 and 10, a U-shaped spring bracket 20*b* is held in the elongated slot 3 of the guide bar 1. The spring bracket 20*b* lies in the groove 15 of the elongated slot 3 and projects beyond a component periphery into the inner space of the elongated slot 3. The ends 25 of the spring bracket 20*b* are bent over outwardly in the plane of the spring bracket and engage in receptacles 26 in the guide bar 1 whereby the spring bracket 20*b* is held in the elongated slot 3 so that it cannot separate therefrom.

As shown in FIG. 10, the bearing collar 11 is held on its side facing away from the housing whereby an inclined surface 18 is formed which facilitates placing the guide bar 1 in the direction of arrow 14. When the guide bar 1 is placed in position, the spring bracket 20*b* is pushed outwardly in the plane of the guide bar into the groove 15 in order to become latched in the peripheral groove 12 of the bearing collar 11 after placement of the guide bar is completed.

Figure 11:
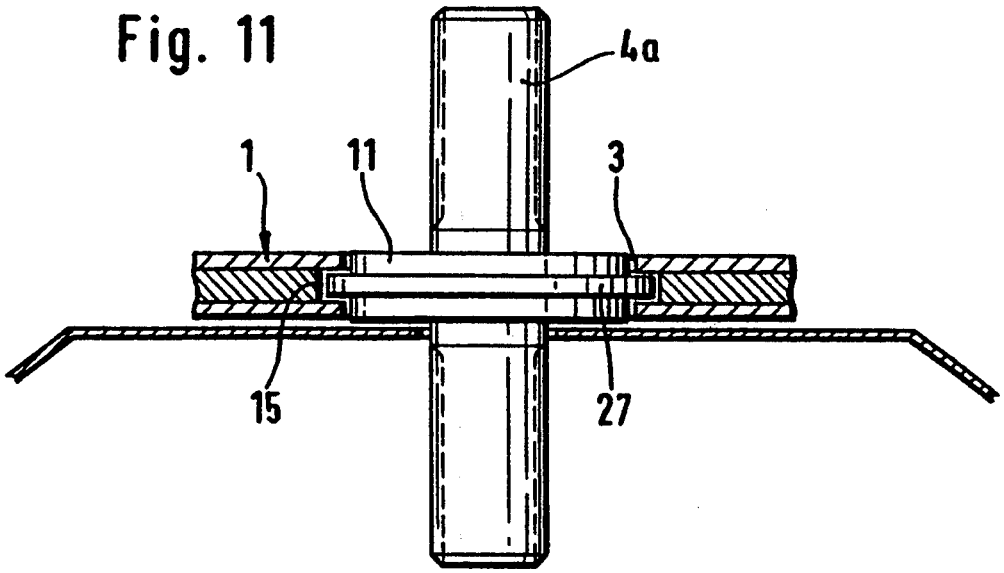
FIG. 11 is a section view taken through an embodiment of a holding device operating pursuant to the groove/spring principle.
Figure 12:
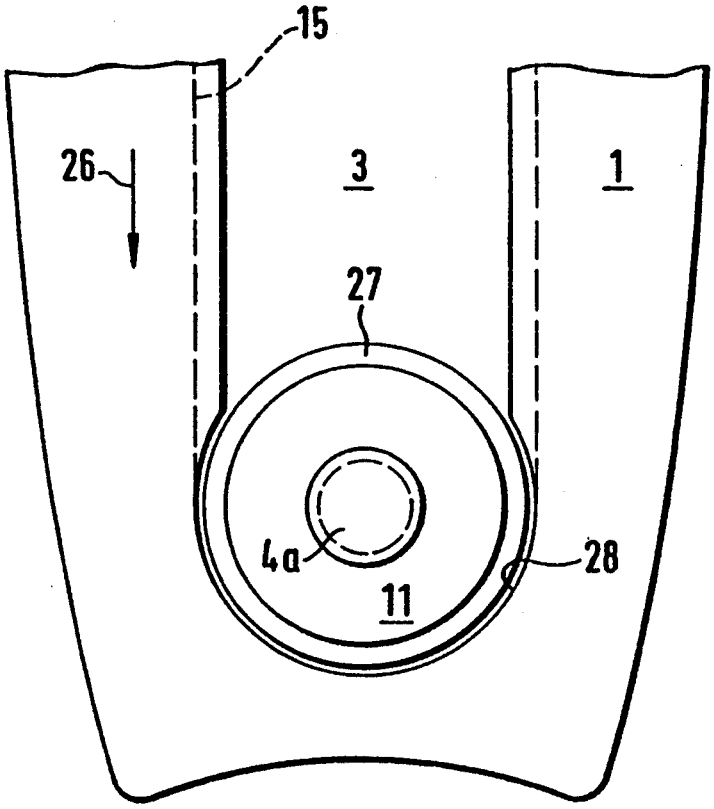
FIG. 12 is a detail view of the rearward end of the guide bar of FIG. 11.

In the embodiments of FIGS. 11 and 12, the collar 11 of a stud bolt 4*a* is provided with a radial annular flange 27 which engages in the peripheral groove 15 of the guide bar 1 pursuant to a spring/groove-connection. The groove 15 is in part open axially to make it possible for the annular flange 27 to enter into the groove 15. An axial inlet opening 28 is advantageously provided on one end of the elongated slot 3 for the annular flange 27.

The axial entry opening is defined by an axial through bore configured in correspondence to the annular flange 27. The guide bar 1 is placed in position axially with the annular flange 27 being fitted into the entry opening 28. When the guide bar 1 is in its correct position on the housing 2, the guide bar is then pushed rearwardly in the longitudinal direction in accordance with arrow 26 whereby the annular flange 27 enters into the groove 15 of the elongated slot 3 thereby preventing the guide bar from tilting.

In the embodiment of FIGS. 13 and 14, a latching member 30 is schematically shown which is attached to the housing 2 of the motor-driven chain saw by being pivoted about an axis 29 extending perpendicularly to the plane of the guide bar 1. In the latched position shown in FIG. 13, the latching member 30 engages over the outer edge 1*b* of the guide bar 1 so that the guide bar is held in its position on the housing 2 so that it cannot tilt even though the sprocket-wheel cover is disassembled. The latching member 30 is advantageously configured so as to be resilient and lies against the side surface of the guide bar 1 under spring force.

In the embodiment of FIGS. 15 and 16, a rotatable latching member 30 is likewise shown which is configured so as to be rectangular with rounded narrow ends as shown in the plan view of FIG. 16. The latching member 30 has a width (b) which is slightly less than the width B of the elongated slot 3 in the guide bar 1. The latching member 30 has a central opening having a serrated edge 31 which engages in a groove 32 of the stud bolt 4*a*. A simple axial assembly of the latching member 30 by pushing the same onto the stud bolt 4*a* is possible because of the serrated edge 31. The groove 32 lies directly next to the collar 11 so that the latching member 30 lies on the axial end of the collar 11 facing away from the housing. In the one rotational position, the rectangularly-shaped latching member 30 is aligned in the longitudinal direction of the elongated slot 3 so that the latching member 30 can pass through the elongated slot because of the lesser width (b). When the collar 11 lies in the elongated slot 3, the latching member 30 is rotated by 90° whereby the latching member 30 engages over the inner edge 16 of the elongated slot 3 in the guide bar 1 and thereby axially secures the guide bar.

Figure 17:
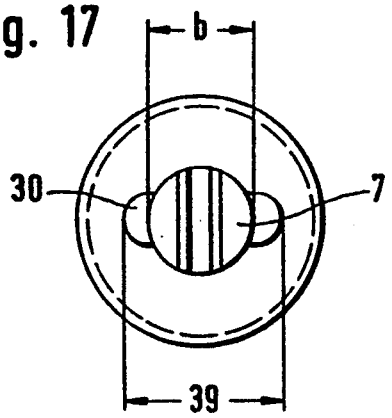
FIG. 17 is a plan view of the adjusting screw of the saw-chain tensioning device having a latching member seated thereon so as to be nonrotatable with respect to the adjusting screw.
Figure 18:
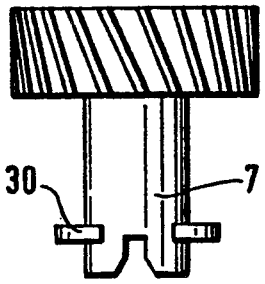
FIG. 18 is a side elevation view of the adjusting screw of FIG. 17.

The adjusting screw 7 of the saw-chain tensioning device carries a latching member 30 in the embodiments of FIGS. 17 and 18. The latching member 30 is seated tight on the adjusting screw 7 so that it cannot rotate with respect thereto. In one rotational position, the width of the latching member 30 is less than the width of the elongated slot of the guide bar 1 as shown in the embodiments of FIGS. 15 and 16. In this way, the guide bar 1 can be placed on the collars 11 of the stud bolts 4*a* and 4*b*. By rotating the adjusting screw 7 by 90°, the longer side 39 of the latching member 30 is aligned transversely to the longitudinal direction of the guide bar with the longer side being wider than the elongated slot 3. The longer side therefore engages over the inner edge of the elongated slot and axially secures the guide bar.

Figure 19:
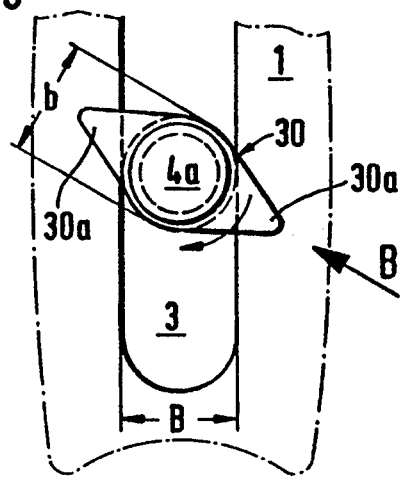
FIG. 19 is a further embodiment of the holding device having a rotatable latching member held by a stud bolt fixed to the housing.
Figure 20:
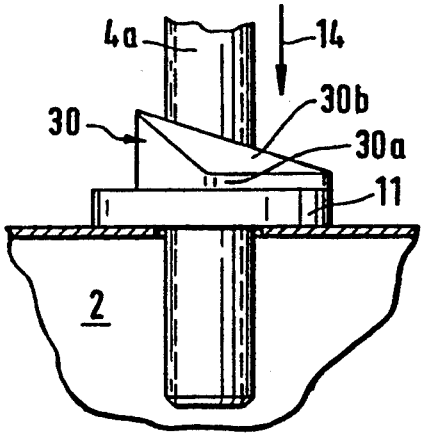
FIG. 20 shows the stud bolt viewed in the direction of arrow B of FIG. 19.

In the embodiment of FIGS. 19 and 20, a rotatable latching member 30 is likewise provided which has a width (b) which is less than the width B of the elongated slot 3. The latching member 30 is extended in one direction with extensions 30*a* with this direction being 90° with respect to the width (b). The extensions 30*a* engage over the guide bar 1 in the latched position shown in FIG. 19. The latching member 30 is resiliently loaded into this latched position.

To facilitate placing the elongated slot 3 on the stud bolts 4*a* and 4*b*, the extensions 30*a* are provided with inclined surfaces 30*b* which face away from the housing 2 of the motor-driven chain saw. When the guide bar 1 is placed in position axially in the direction of arrow 14, a rotational movement in the direction of arrow 14 is generated because of the force relationships at the inclined surface 30*b* whereby the extensions 30*a* come to lie in the longitudinal direction of the elongated slot 3. In this way, the latching member 30 can be axially fitted into the elongated slot 3 and is pivoted back into the latching position shown in FIG. 19 because of the acting spring force. This takes place as soon as the guide bar comes to rest below the latching member 30. The latching member 30 lies directly adjacent the collar 11 of the stud bolt 4*a*.

Latching members are shown in FIGS. 21 to 30 which lie above the guide bar 1 and engage over the edges 16 for securing the guide bar 1. The latching member can be configured in correspondence to the spring ring 13 in FIG. 2 with the peripheral groove 12 being so arranged that the spring ring 13 engages over the edge 16*a*, that is, the spring ring 13 becomes latched above the plane of the guide bar 1.

Figure 21:
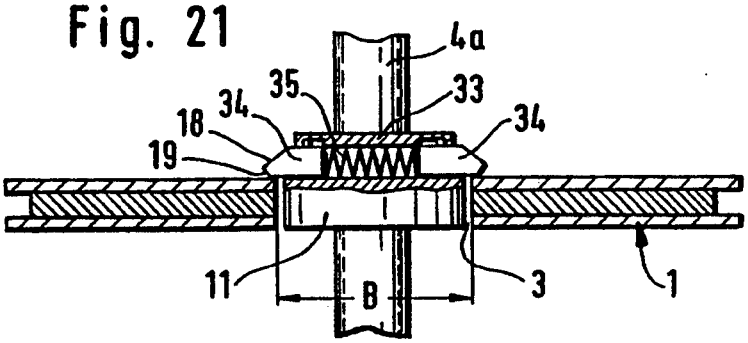
FIG. 21 is a section view of a further embodiment of the holding device of the invention having latching pins engaging the guide bar.

In the embodiment of FIG. 21, a receptacle 33 for two latching pins 34 is provided above the bearing collar 11. The latching pins 34 are guided so as to be displaceable in the direction of the width B of the elongated slot 3. The latching pins 34 are resiliently biased into their latching positions by a spring 35 as shown in FIG. 21. The ends projecting out of the receptacle 33 have respective inclined surfaces 18 and 19 with the inclined surface 18 having a lesser slope and facing away from the bearing collar 11; whereas, the inclined surface 19 has a steeper slope than the slope of inclined surface 18 and lies facing toward the bearing collar 11 and engages in the latched position shown over the edge 16 of the elongated slot 3 in the guide bar 1.

Figure 22:
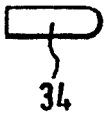
FIG. 22 is a side elevation view of one of the latching pins shown in FIG. 21.

The latching pins 34 can be rounded at the ends thereof projecting out of the receptacle 33, that is, the ends can be configured so as to be half-round as shown in FIG. 22.

Figure 23:
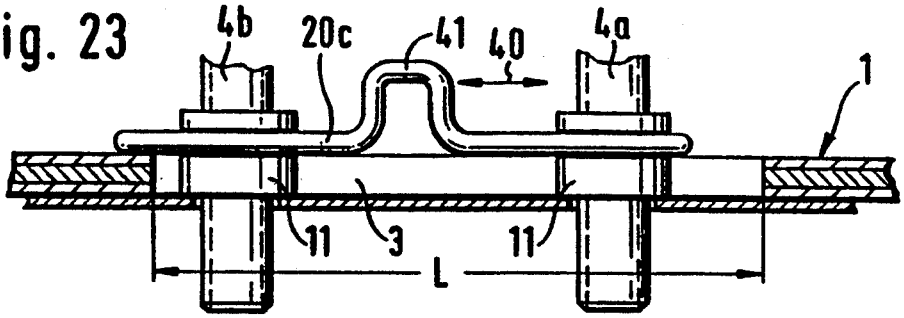
FIG. 23 is a side elevation view of a further embodiment of the holding device having a spring bracket displaceable in the longitudinal direction of the guide bar for widening the same.
Figure 24:
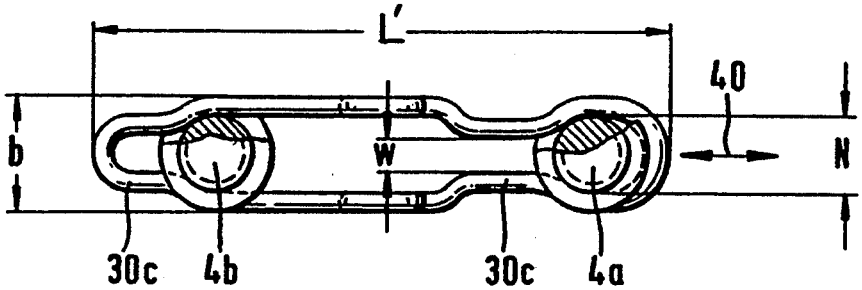
FIG. 24 is a plan view of the spring bracket of FIG. 23.

The guide bar is held by a spring bracket 20*c* in the embodiments of FIGS. 23 and 24. In this embodiment, the guide bar is seated with its elongated slot 3 on the respective collars 11 of the stud bolts 4*a* and 4*b*. The spring bracket 20*c* is held so as to be displaceable parallelly to the plane of the guide bar in bearing grooves which follow the collars 11. When viewed in plan, the spring bracket 20*c* has essentially a rectangular closed form having a length L' which is less than the length L of the elongated slot 3 in the guide bar 1. The width (b) of the spring bracket 20*c* measured transversely to the longitudinal slot 3 is less than the width B (FIG. 2) of the elongated slot 3 when the spring bracket 20*c* is in its expanded rest position. The spring bracket 20*c* further has two sections 30*c* configured to have a lesser width and having an inner clear space (w) which is less than the diameter N of the stud bolts 4*a* and 4*b* measured at the base of the groove. This results in the narrower section 30*c* being widened by the groove base when the spring bracket 20*c* is displaced in the longitudinal direction of the guide bar 1 (arrow 40) whereby the entire spring bracket 20*c* is increased with respect to its width and thereby projects over the guide bar 1 at both edges of the elongated slot 3. The guide bar is held on the housing so that it cannot become separated therefrom.

An actuating section 41 is bent out of the plane of the guide bar 1 to facilitate actuation of the spring bracket 20*c* in the direction of arrow 40 as shown in FIG. 23.

Figure 25:
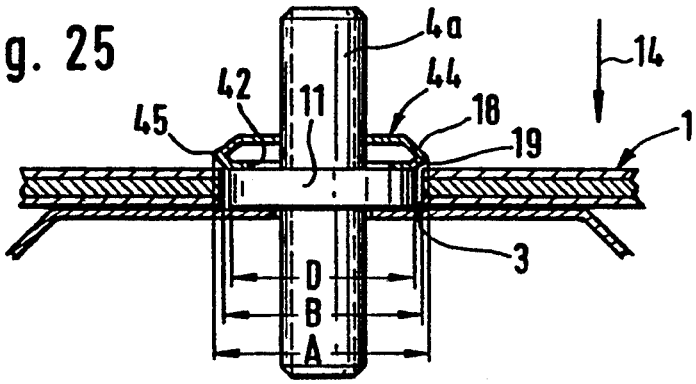
FIG. 25 is a further embodiment of the holding device of the invention which includes a spring disc seated on the stud bolts.
Figure 26:
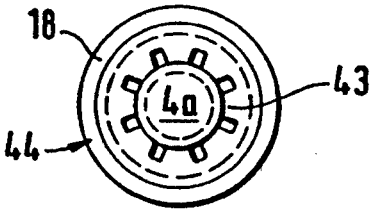
FIG. 26 is a plan view of the stud bolt equipped with the spring disc of FIG. 25.

In the embodiment of FIGS. 25 and 26, a plate-shaped spring disc 44 is clipped onto a stud bolt 4*a* having a bearing collar 11 as disclosed above. The spring disc 44 engages with its inner serrated edge 43 in the thread of the stud bolt 4*a* and is thereby axially secured against being separated therefrom. The edge of the plate disc is bent over in the same manner as the spring ring of FIG. 3 so that inclined surfaces 18 and 19 are formed. The bent-over inner free edge 42 of the spring disc 44 is in axial contact engagement with the bearing collar 11. The outer edge 45 of the spring disc 44 has an outer diameter A which is greater than the diameter D of the collar 11 and greater than the width B of the elongated slot 3.

A guide bar 1 placed in direction of arrow 14 on the stud bolts 4*a* and 4*b* first pushes the spring discs radially inward until the spring discs are passed over in the axial direction and so that the spring discs can return to their rest position as shown in FIG. 25. In this rest position, the spring discs engage over the inner edge 16 of the elongated slot 3 because of their outer diameter A whereby the guide bar is axially secured.

Figures 27, 28:
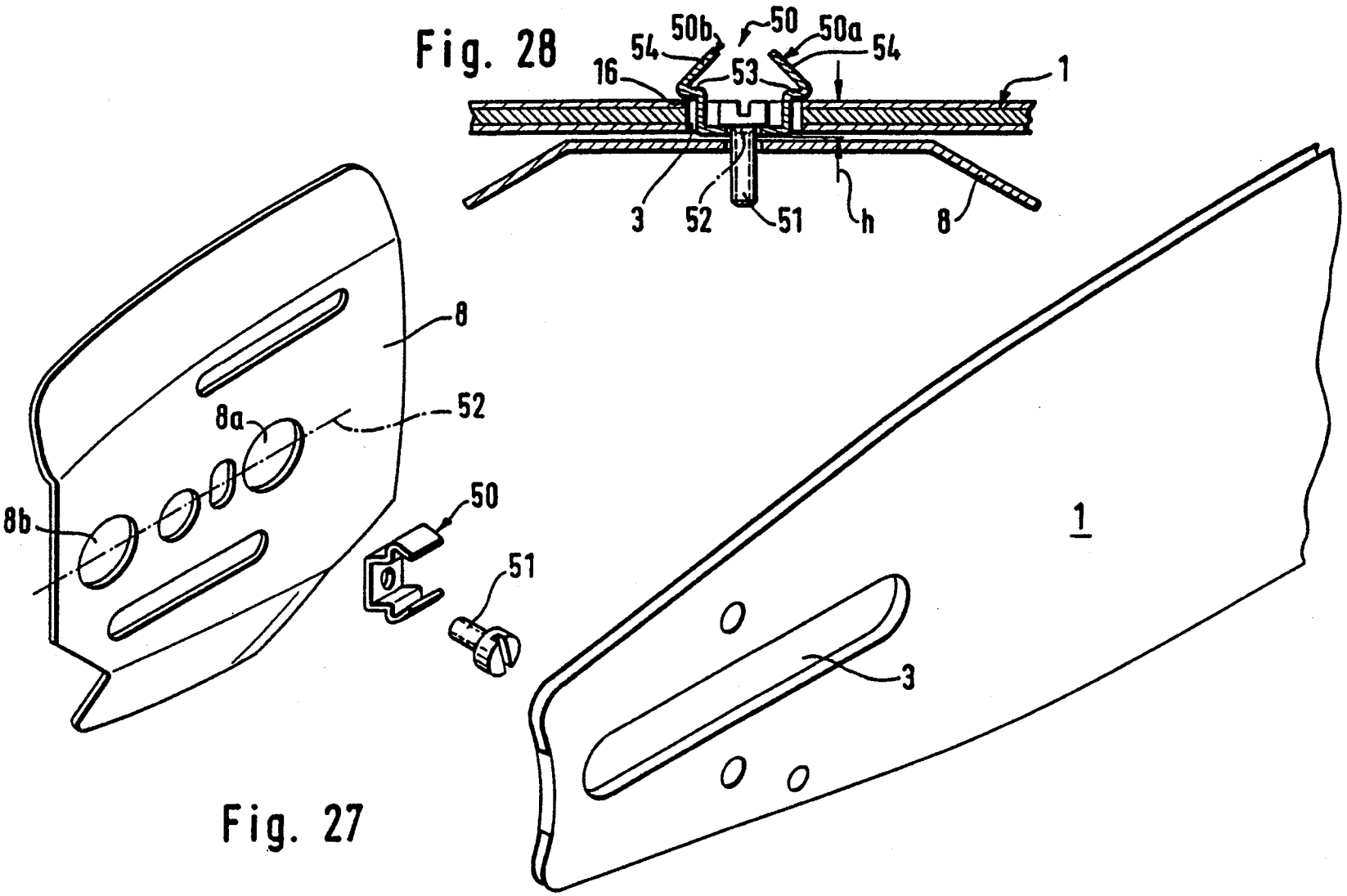
FIG. 27 is a view corresponding to that of FIG. 1 showing the arrangement of a resilient latching member on a side wall of the motor-driven chain saw.
FIG. 28 is a section view taken through the embodiment of FIG. 27.

In the embodiment of FIGS. 27 and 28, a U-shaped spring bracket 50 is fixed by means of an attachment screw 51 to the side wall 8, that is, to the housing disposed therebelow. The U-shaped legs 50*a*, 50*b* of the spring bracket 50 are bent over outwardly at right angles at an elevation (h) with the elevation (h) corresponding approximately to the thickness of the guide bar 1. The free leg ends 54 are then bent back inwardly and define an acute angle. The free leg ends 54 of the legs 50*a* and 50*b* extend toward each other. The U-shaped bracket lies symmetrically to the connecting axis 52 of the two stud bolts, that is, to the openings 8*a* and 8*b* provided for the stud bolts in the side wall 8. When setting the guide bar 1 on the stud bolts (not shown in FIG. 27), the spring bracket 50 therefore enters the elongated slot 3 with its free leg ends 54 and is pressed together until the guide bar has passed over step 53, which is formed in the legs 50*a* and 50*b*, and the legs resiliently return into their latching position shown in FIG. 28. In this latching position, the steps 53 of the legs 50*a* and 50*b* extend over the inner edges 16 of the elongated slot 3 and axially secure the guide bar. The inner edges 16 extend in the longitudinal direction of the guide bar 1.

Figure 30:
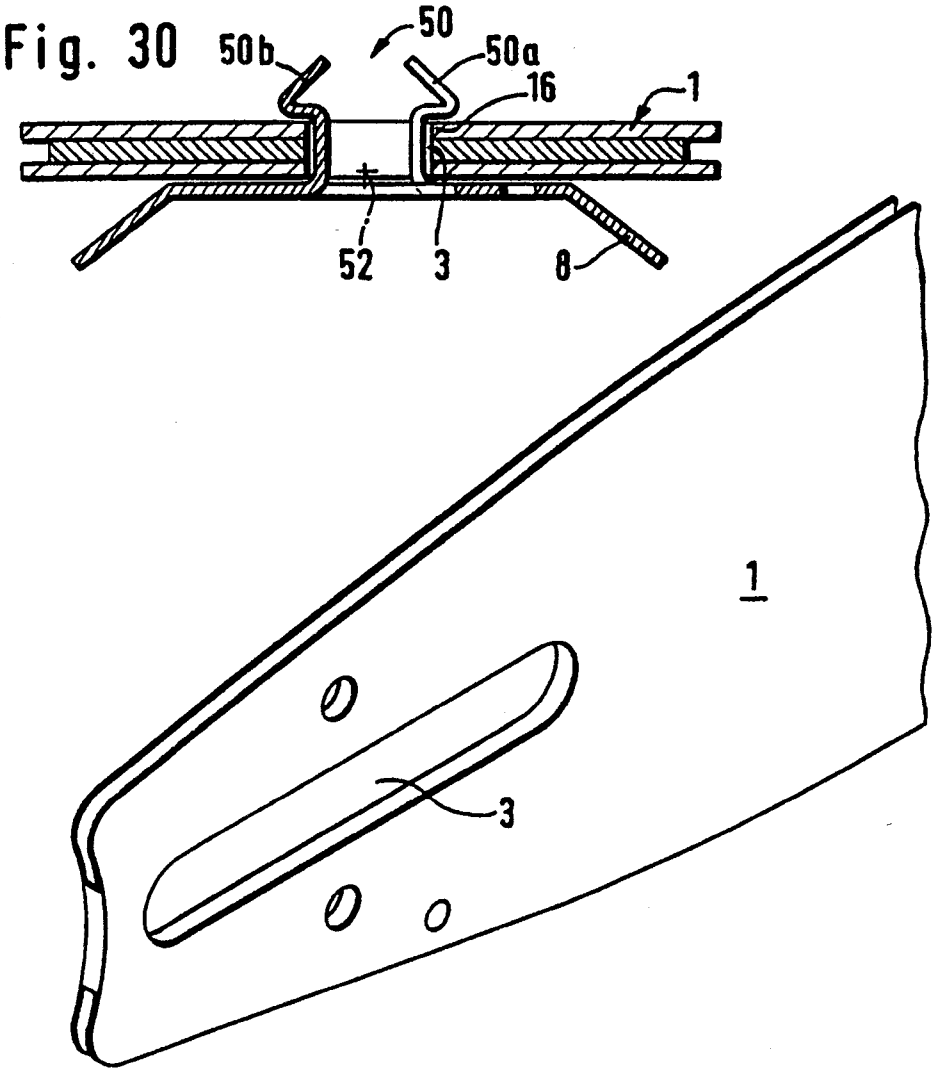
FIG. 30 is a section view taken through the embodiment of FIG. 29.
Figure 29:
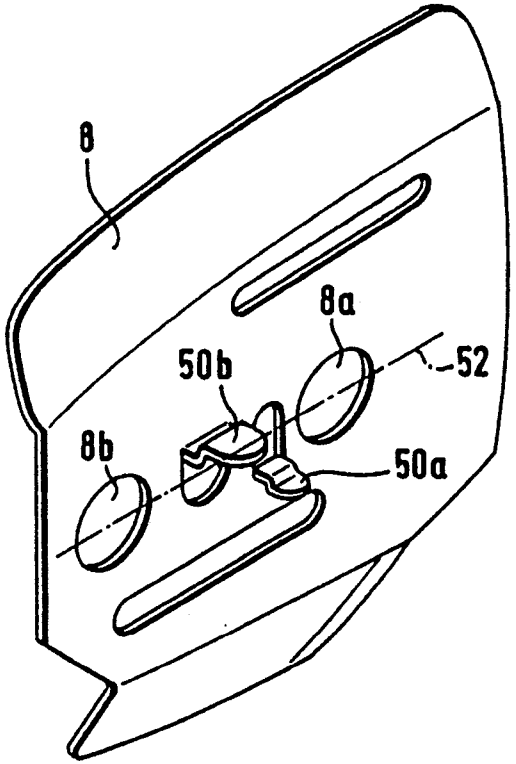
FIG. 29 is a view corresponding to that of FIG. 1 with resilient latching members bent out of a side wall.

In the embodiment of FIGS. 29 and 30, the spring-elastic legs 50*a* and 50*b* are stamped from the side wall 8 and are turned up approximately perpendicularly. The spring bracket 50 is U-shaped when viewed in the axial direction and is thereby defined by the side wall 8 as base plate and the upturned spring legs 50*a* and 50*b*. The configuration of the legs, their dimensions and their function correspond to those shown in FIGS. 27 and 28.

Figure 31:
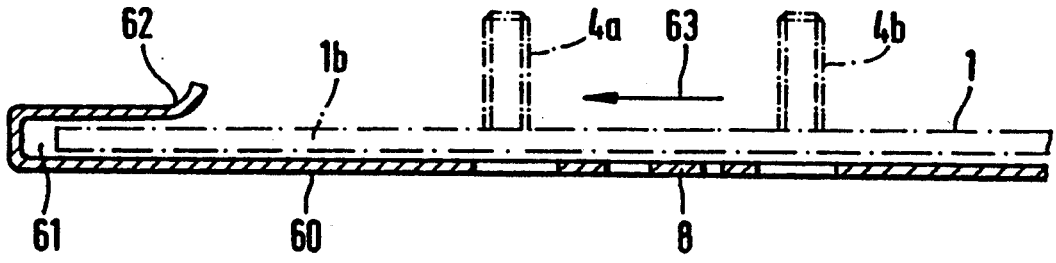
FIG. 31 is a section view of a side wall with a holding bracket engaging over the edge of the guide bar viewed in the longitudinal direction.
Figure 32:
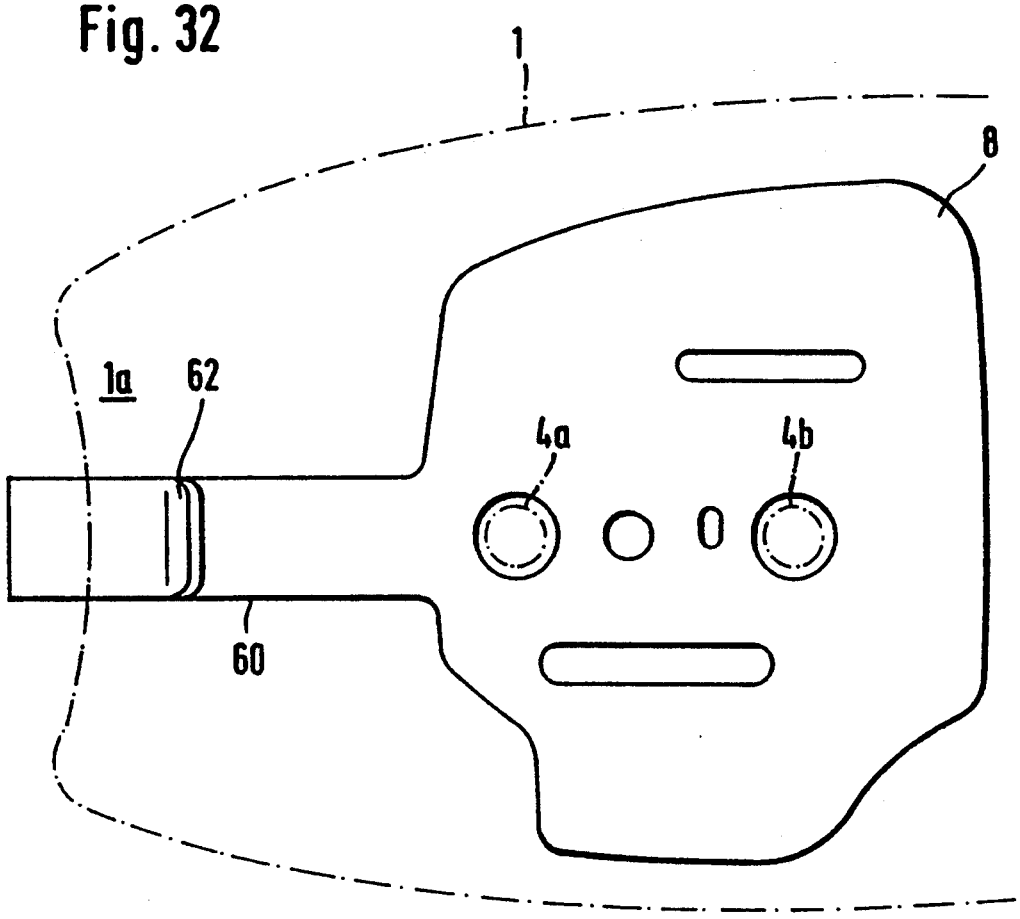
FIG. 32 is a plan view of the side wall of FIG. 31.

In the embodiment of FIGS. 31 and 32, the side wall 8 is provided with an elongated extension 60 extending over the rearward end 1*a* of the guide bar 1. The free end of the elongated extension 60 is folded over in the longitudinal direction of the guide bar and defines a receptacle 61 for the rearward end 1*a* of the guide bar. For placing the guide bar 1 in position, the rearward end 1*a* thereof is first introduced into the receptacle 61 with the over-extending tongue 62 being bent up in a spring-elastic manner. The stud bolts are then introduced into the elongated slot and the guide bar 1 is placed on the side wall 8. A tipping of the guide bar is prevented.

The arrangement can be so configured with respect to dimensions that the guide bar 1 is placed axially on the stud bolts 4*a* and 4*b* with the rearward end 1*a* passing axially the tongue 62. This can be achieved by a correspondingly dimensioned length of the extension 60 or by means of a correspondingly short tongue 62. When the guide bar is placed on the side wall 8, the guide bar is displaced in the direction of arrow 63. The rearward end 1*a* then enters the receptacle 61 and the position is secured. The elongated slot must be configured so as to be adequately long for a displacement of this kind in the longitudinal direction of the guide bar.

Figure 33:
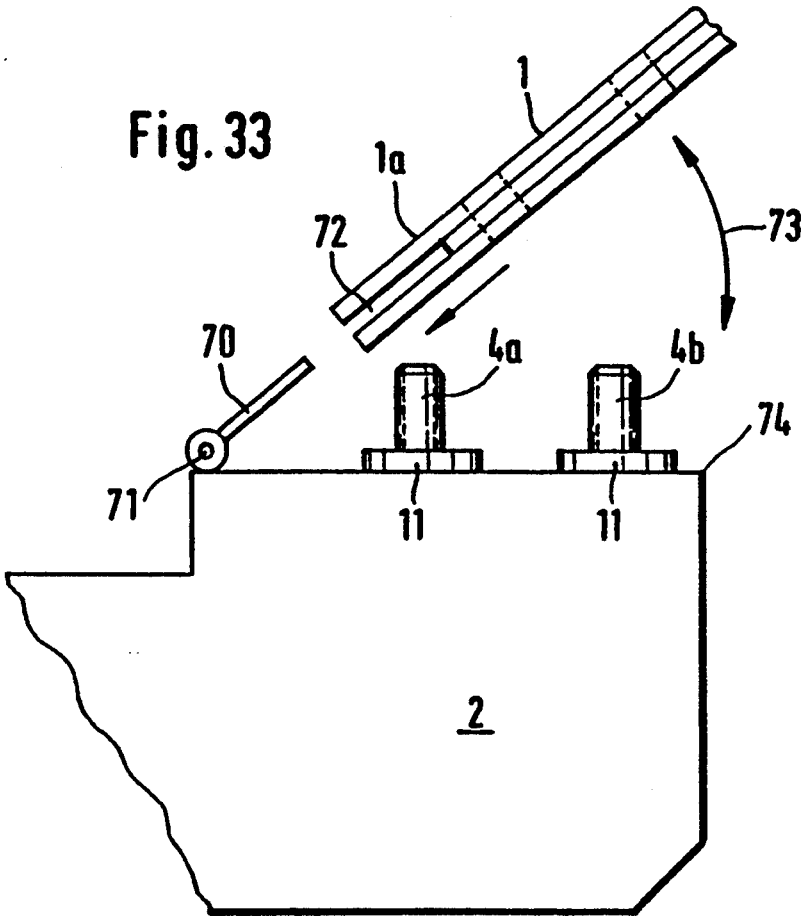
FIG. 33 is a schematic of a further embodiment of the holding device according to the invention.

In another embodiment of the invention, according to FIG. 33, a lug 70 is attached in the longitudinal direction of the guide bar at the rearward end 1*a* thereof. The lug 70 is pivotable about a pivot axis 71 lying parallel to the side wall 8. The pivot axis 71 lies transversely to the longitudinal center axis of the guide bar 1 in the plane thereof.

The rearward end 1*a* of the guide bar 1 includes a receptacle 72 extending in the longitudinal direction of the guide bar. The receptacle 72 is configured so as to be adapted to the lug 70. For placing the guide bar, the guide bar is first placed with its end 1*a* on the lug 70 and then dropped in the direction of arrow 73 with the stud bolts 4*a* and 4*b* being passed through the elongated slot 3. The guide bar 1 now lying on the housing 2 of the chain saw cannot tip about the forward edge 74 of the housing since the guide bar is held at its rearward end 1*a* by the lug 70.

Figure 34:
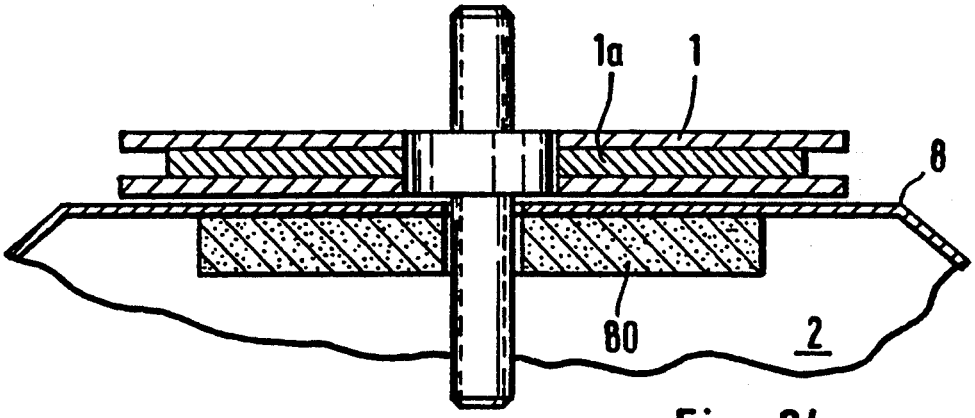
FIG. 34 is a holding device comprising a magnet fixed on the housing.

A magnet 80 is arranged rearward of the side wall 8 in accordance with a simple embodiment of the invention shown in FIG. 34. The magnet holds the end 1*a* of the guide bar in its position on housing 2. In the embodiment shown, the magnet 80 is penetrated by the threaded bolts and extends far over the complete width of the guide bar 1.

Figure 35:
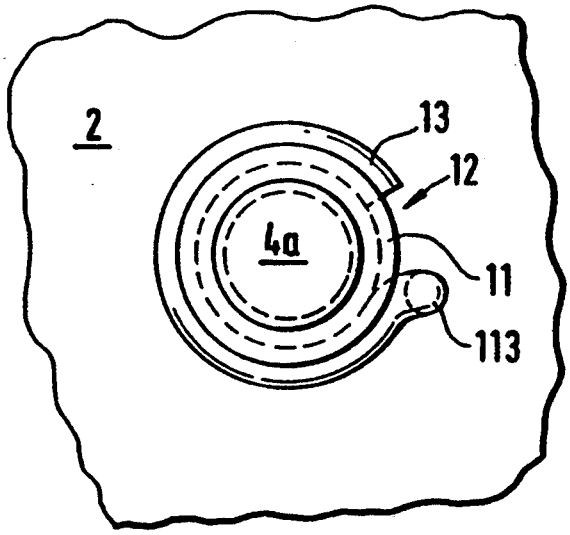
FIG. 35 is a plan view of a stud bolt having a spring ring fixed in position.
Figure 36:
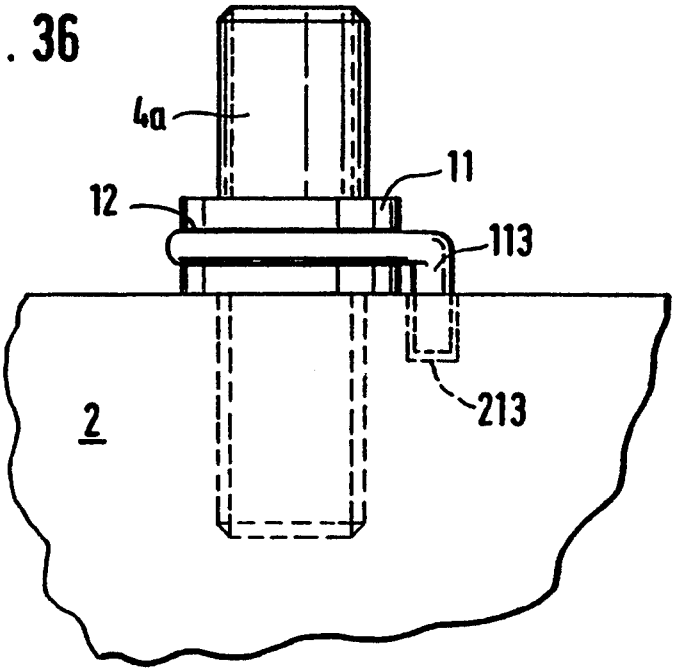
FIG. 36 is a side elevation view of the stud bolt of FIG. 35.

The spring ring 13 (FIG. 2) is secured in position as shown in the plan view of FIG. 35. The split spring ring 13 is held in a peripheral groove 12 of the collar 11 of the stud bolt 4*a* and is bent over at a leg end 113 thereof. The leg end 113 lies approximately perpendicularly to the plane defined by the spring ring 13 and engages in an opening 213 (FIG. 36) in the housing 2. The opening 213 is preferably defined by a bore disposed perpendicularly to the side of the housing and lies on the side of the housing (when viewed in plan) in the region between the threaded bolts lying at a spacing relative to each other. When the guide bar placed in position, the opening 213 lies within the region of the elongated slot so that the leg end 113 does not impede the assembly, the positioning and the adjustment of the guide bar. Securing the guide bar in position in this manner ensures that the spring ring is loaded in a predetermined way when the guide bar is placed in position (FIG. 2). The slit of the spring ring 13 faces away from the latch groove 15 in the elongated slot 3 (FIGS. 1 and 2). The longitudinal center axis of the elongated slot 3 preferably partitions the slit of the spring ring 13. When the guide bar is placed in position, the spring ring 13 provides a resilient support about an annular section lying diametrically opposite the slot 3.

Figure 37:
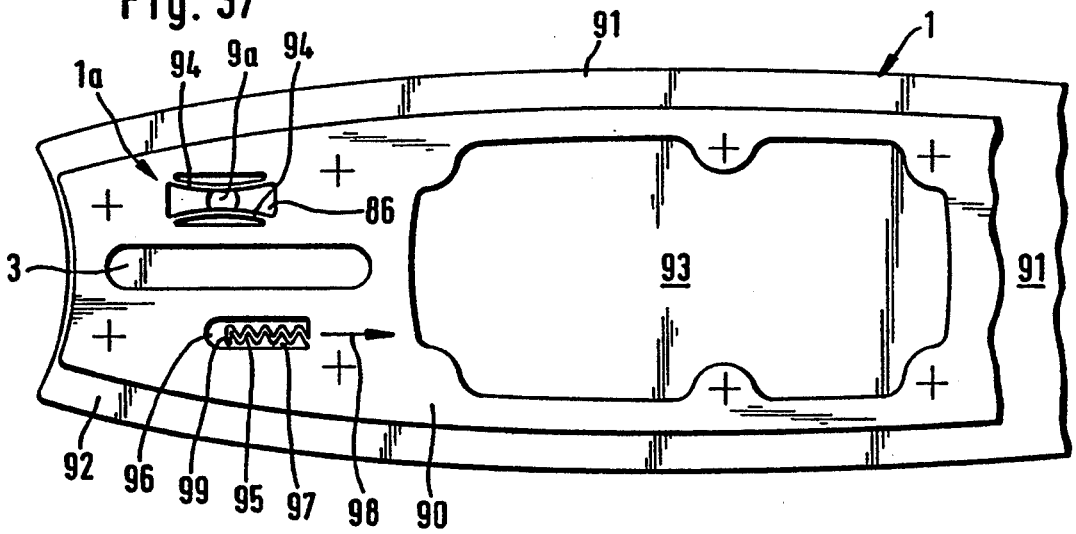
FIG. 37 is a schematic detail view of a guide bar having an integrated holding device.
Figure 38:
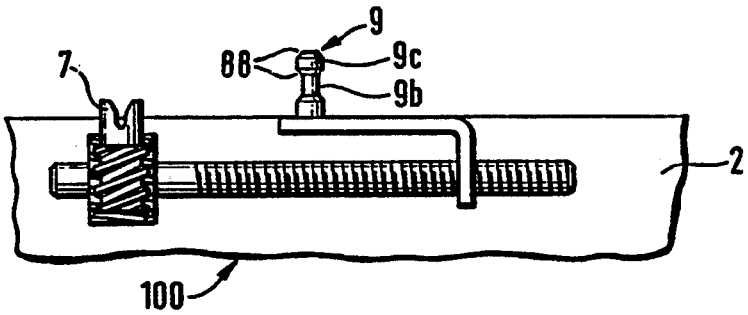
FIG. 38 is a schematic of a saw-chain tensioning device.
Figure 39:
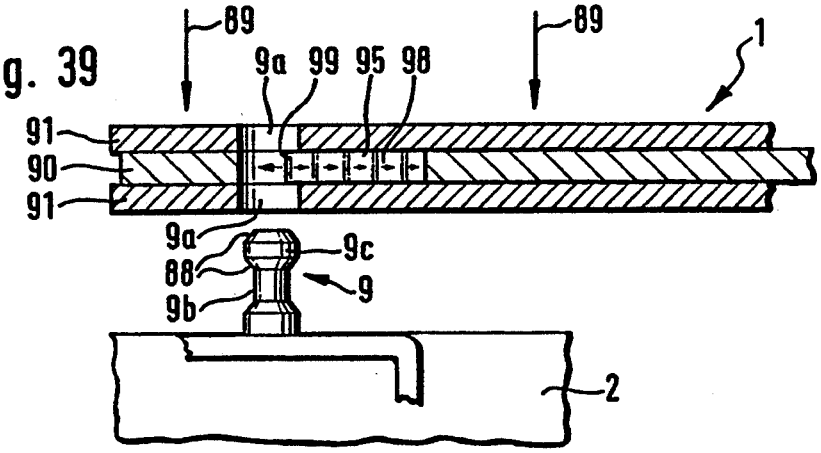
FIG. 39 is a schematic of a guide bar preparatory to seating the same on the adjusting pin of the saw-chain tensioning device of FIG. 38.

In a further embodiment of the invention according to FIGS. 37 to 39, the holding device provided at the rearward end 1*a* of the guide bar 1 is defined by the positioning pin 9 (FIG. 38) of a saw-chain tensioning device 100 arranged in the housing 2 of the motor-driven chain saw. The adjusting pin coacts with a spring provided on the guide bar 1.

The guide bar has a sandwich-like configuration and comprises a center plate 90 arranged between two side plates 91. The center plate 90 is smaller than the side plates 91 thereby defining a guide groove 92 in the peripheral edge of the guide bar 1 wherein the drive links of a moving saw chain can engage. As described above, the guide bar 1 has an elongated slot 3 in the rearward end 1*a* of the guide bar with the elongated slot 3 being aligned in the longitudinal direction of the guide bar 1. Stud bolts fixed to the housing project through the elongated slot for clamping the guide bar.

The center plate 90 of the guide bar 1 has a cutout 93 for reducing weight. The cutout 93 is completely covered by the side plates 91.

The center plate 90 is preferably made of metal and has a punching 96 by means of which a flat spring 95 is formed. This punching is shown in the embodiment according to FIG. 37 and is disposed below the elongated slot 3. The flat spring 95 lies in an elongated slot 97. The flat spring 95 is elastically-deformable in the direction of arrow 98. The flat spring 95 is formed as one piece with the center plate 90 and is formed therefrom by the punching operation. The free end 99 borders a free end region of the slot 96. Access openings 9*a* for the adjusting pin 9 are provided in the side plates 91 with the access opening 9*a* being aligned with the free end region of the slot 96. Viewed in plan, the free end 99 projects into the access openings 9*a*. The adjusting pin 9 has a peripheral groove 9*b*.

The adjusting pin 9 enters into the access openings 9*a* aligned with respect to each other when the guide bar 1 is placed on the housing 2 in the direction of the arrow 89 in FIG. 39. The free end 99 of the flat spring 95 is first pushed back by head 9*c* of the adjusting pin 9 and then latches in the opposite direction in the peripheral groove 9*b*. The guide bar is held on the housing 2 so that it cannot separate therefrom so that a saw chain can be easily placed on the guide bar.

The head 9*c* has peripheral receiving inclines 88 in order to facilitate latching of the flat spring 95 when the guide bar 1 is placed in position in the direction of arrow 89 as well as facilitating the detachment of the flat spring 95 when removing the guide bar 1.

A leaf spring 94 can be punched out in lieu of a flat spring 95 as indicated above the elongated slot in FIG. 37. The punched leaf spring 94 defines the longitudinal side of an elongated slot 86. The access opening 9*a* in the side plates 91 of the guide bar 1 are so provided that the leaf spring 94 projects into the opening (when the access opening 9*a* is viewed in plan) so that an adjusting pin 9, which is pressed into the access opening 9*a*, is latched to the guide bar 1 when the leaf spring 94 drops into the peripheral groove 9*b* and which therefore holds the guide bar 1 on the housing 2. The leaf spring 94 can also be provided on the longitudinal edges of the elongated slot 3 for the stud bolts fixed to the housing.

It is understood that the foregoing description is that of the preferred embodiments of the invention and that various changes and modifications may be made thereto without departing from the spirit and scope of the invention as defined in the appended claims.

What is claimed is:

1. A motor-driven chain saw defining a longitudinal axis and being equipped with a saw chain and a drive motor for driving the saw chain via a sprocket wheel, the motor-driven chain saw comprising:

a housing for accommodating the drive motor therein;

a guide bar having a guide groove for guiding the saw chain; said guide bar having a rearward end facing toward the housing where said guide bar is mounted on said housing so as to extend forwardly from said housing in the direction of said axis;

said guide bar having an elongated slot formed in said rearward end;

at least one threaded bolt fixedly mounted on said housing and extending through said elongated slot transversely to said axis when said guide bar is mounted on said housing;

a sprocket-wheel cover for covering the sprocket wheel;

threaded clamping means for threadably engaging said threaded bolt for clamping said rearward end of said guide bar between said housing and said cover;

said guide bar having a predetermined position on said housing when mounted and held on said housing;

a holding device for holding said rearward end in said predetermined position on said housing when said cover is removed;

said holding device being separate from said cover;

said holding device including said guide bar having an inner surface defining said elongated slot and said inner surface having an edge; a latching member being displaceable between a first position wherein said guide bar can be lifted off said housing and a second position wherein said guide bar is latched onto said housing; and, said latching member extending beyond said edge when in said second position thereby latching said guide bar to said housing in said predetermined position thereof.

2. The motor-driven chain saw of claim 1, said latching member being made so as to be resilient.

3. The motor-driven chain saw of claim 1, said holding device further comprising holding means on said threaded bolt for holding said latching member thereon; said latching member being a resilient split ring mounted on said holding means and being compressible so as to be in said first position and relaxed so as to be in said second position.

4. The motor-driven chain saw of claim 3, said holding means further comprising groove means formed in said inner surface to define said edge and receive said split ring therein when in said second position.

5. The motor-driven chain saw of claim 3, said housing having an opening formed therein; and, said split ring having a leg extending therefrom and into said opening.

6. The motor-driven chain saw of claim 1, said threaded bolt being a first threaded bolt and said motor-driven chain saw comprising a second threaded bolt likewise fixedly mounted on said housing and extending through said elongated slot transversely to said axis; said threaded bolts being spaced from each other at a predetermined spacing; said holding device further comprising holding means on said threaded bolts for holding said latching member thereon; and, said latching member having essentially an S-shape and being mounted on said holding means so as to extend between said threaded bolts.

7. The motor-driven chain saw of claim 6, said holding means further comprising groove means formed in said inner surface to define said edge and receive said latching member therein when in said second position.

8. The motor-driven chain saw of claim 1, said threaded bolt being a first threaded bolt and said motor-driven chain saw comprising a second threaded bolt likewise fixedly mounted on said housing and extending through said elongated slot transversely to said axis; said threaded bolts being spaced from each other at a predetermined spacing; said holding device further comprising holding means on said threaded bolts for holding said latching member thereon; and, said latching member having essentially a U-shape and being mounted on said holding means so as to straddle said threaded bolts.

9. The motor-driven chain saw of claim 8, said holding means further comprising groove means formed in said inner surface to define said edge and receive said latching member therein when in said second position.

10. The motor-driven chain saw of claim 1, said threaded bolt being a first threaded bolt and said motor-driven chain saw comprising a second threaded bolt likewise fixedly mounted on said housing and extending through said elongated slot transversely to said axis; said threaded bolts being spaced from each other at a predetermined spacing; said holding device further comprising holding means on said threaded bolts for holding said latching member thereon; and, said latching member having an essentially closed elongated O-shape and being mounted on said holding means so as to be displaceable thereon between said first and second positions in the direction of said axis.

11. The motor-driven chain saw of claim 10, said holding device further comprising means for widening said latching member when said latching member is displaced into said second position.

12. A motor-driven chain saw defining a longitudinal axis and being equipped with a saw chain and a drive motor for driving the saw chain via a sprocket wheel, the motor driven chain saw comprising:

a housing for accommodating the drive motor therein;

a guide bar having a guide groove for guiding the saw chain; said guide bar having a rearward end facing toward the housing where said guide bar is mounted on said housing so as to extend forwardly from said housing in the direction of said axis;

said guide bar having an elongated slot formed in said rearward end;

at least one threaded bolt fixedly mounted on said housing and extending through said elongated slot transversely to said axis when said guide bar is mounted on said housing;

a sprocket-wheel cover for covering the sprocket wheel;

threaded clamping means for threadably engaging said threaded bolt for clamping said rearward end of said guide bar between said housing and said cover;

said guide bar having a predetermined position on said housing when mounted and held on said housing;

a holding device for holding said rearward end in said predetermined position on said housing when said cover is removed;

said guide bar having an outer edge and being a flat member defining a plane; and, said holding device including a lever pivotally mounted on said housing so as to be pivotally movable between a first position wherein said guide bar can be lifted off said housing and a second position wherein said lever engages over said outer edge so as to hold said guide bar in said predetermined position thereof.

13. The motor-driven chain saw of claim 12, said lever being resilient for applying a resilient force to said guide bar when said lever is in said second position.

14. A motor-driven chain saw defining a longitudinal axis and being equipped with a saw chain and a drive motor for driving the saw chain via a sprocket wheel, the motor-driven chain saw comprising:

a housing for accommodating the drive motor therein;

a guide bar having a guide groove for guiding the saw chain; said guide bar having a rearward end facing toward the housing where said guide bar is mounted on said housing so as to extend forwardly from said housing in the direction of said axis;

said guide bar having an elongated slot formed in said rearward end;

at least one threaded bolt fixedly mounted on said housing and extending through said elongated slot transversely to said axis when said guide bar is mounted on said housing;

a sprocket-wheel cover for covering the sprocket wheel;

threaded clamping means for threadably engaging said threaded bolt for clamping said rearward end of said guide bar between said housing and said cover;

said guide bar having a predetermined position on said housing when mounted and held on said housing;

a holding device for holding said rearward end in said predetermined position on said housing when said cover is removed;

said guide bar having an inner surface defining said elongated slot; and, said holding device including groove means formed in said inner surface; a latching member being displaceable between a first position when said guide bar is lifted off said housing and a second position wherein said guide bar is latched onto said housing; said latching member being a U-shaped member mounted in said elongated slot so as to extend partially into said groove means when in said second position and being expanded into said groove means when in said first position; and, holding means on said threaded bolt for holding said latching member when in said second position.

15. The motor-driven chain saw of claim 14, said holding means having a groove formed thereon for receiving said latching member when in said second position.

16. A motor-driven chain saw defining a longitudinal axis and being equipped with a saw chain and a drive motor for driving the saw chain via a sprocket wheel, the motor-driven chain saw comprising:

a housing for accommodating the drive motor therein;

a guide bar having a guide groove for guiding the saw chain; said guide bar having a rearward end facing toward the housing where said guide bar is mounted on said housing so as to extend forwardly from said housing in the direction of said axis;

said guide bar having an elongated slot formed in said rearward end;

at least one threaded bolt fixedly mounted on said housing and extending through said elongated slot transversely to said axis when said guide bar is mounted on said housing;

a sprocket-wheel cover for covering the sprocket wheel;

threaded clamping means for threadably engaging said threaded bolt for clamping said rearward end of said guide bar between said housing and said cover;

said guide bar having a predetermined position on said housing when mounted and held on said housing;

a holding device for holding said rearward end in said predetermined position on said housing when said cover is removed; and, said holding device including said guide bar having an inner surface defining said elongated slot; groove means formed in said inner surface; holding means arranged on said threaded bolt; a latching ball held in said holding means so as to be movable between a first position wherein said guide bar can be lifted off said housing and a second position wherein said latching ball extends into said groove means thereby latching said guide bar onto said housing in said predetermined position thereof; and, resilient biasing means for resiliently biasing said latching ball into said second position.

17. The motor-driven chain saw of claim 16, said holding means being a collar on said threaded bolt; said collar defining a passage therein for holding said latching ball so as to permit said latching ball to move between said first and second positions.

18. A motor-driven chain saw defining a longitudinal axis and being equipped with a saw chain and a drive motor for driving the saw chain via a sprocket wheel, the motor-driven chain saw comprising:

a housing for accommodating the drive motor therein;

a guide bar having a guide groove for guiding the saw chain; said guide bar having a rearward end facing toward the housing where said guide bar is mounted on said housing so as to extend forwardly from said housing in the direction of said axis;

said guide bar having an elongated slot formed in said rearward end;

at least one threaded bolt fixedly mounted on said housing and extending through said elongated slot transversely to said axis when said guide bar is mounted on said housing;

a sprocket-wheel cover for covering the sprocket wheel;

threaded clamping means threadably engaging said threaded bolt for clamping said rearward end of said guide bar between said housing and said cover;

said guide bar having a predetermined position on said housing when mounted and held on said housing;

a holding device for holding said rearward end in said predetermined position on said housing when said cover is removed;

said guide bar having a flat outer surface extending away from said elongated slot; and, said holding device including holding means on said threaded bolt; a latching pin held in said holding means so as to be movable between a first position wherein said guide bar can be lifted off said housing and a second position wherein said latching pin projects over said flat outer surface thereby latching said guide bar onto said housing in said predetermined position thereof; and, resilient biasing means for resiliently biasing said latching pin into said second position.

19. A motor-driven chain saw defining a longitudinal axis and being equipped with a saw chain and a drive motor for driving the saw chain via a sprocket wheel, the motor-driven chain saw comprising:

a housing for accommodating the drive motor therein;

a guide bar having a guide groove for guiding the saw chain; said guide bar having a rearward end facing toward the housing where said guide bar is mounted on said housing so as to extend forwardly from said housing in the direction of said axis;

said guide bar having an elongated slot formed in said rearward end;

at least one threaded bolt fixedly mounted on said housing and extending through said elongated slot transversely to said axis when said guide bar is mounted on said housing;

a sprocket-wheel cover for covering the sprocket wheel;

threaded clamping means for threadably engaging said threaded bolt for clamping said rearward end of said guide bar between said housing and said cover;

said guide bar having a predetermined position on said housing when mounted and held on said housing;

a holding device for holding said rearward end in said predetermined position on said housing when said cover is removed;

said housing having a side wall for receiving said rearward end when said guide bar is mounted on said housing; and, said holding device including a latching member fixedly mounted on said side wall for engaging said guide bar in said elongated slot and resiliently holding said guide bar on said housing.

20. The motor-driven chain saw of claim 19, said side wall being made of sheet metal and said latching member being a U-shaped member having legs punched from said sheet metal.

21. A motor-driven chain saw defining a longitudinal axis and being equipped with a saw chain and a drive motor for driving the saw chain via a sprocket wheel, the motor-driven chain saw comprising:

a housing for accommodating the drive motor therein;

a guide bar having a guide groove for guiding the saw chain; said guide bar having a rearward end facing toward the housing where said guide bar is mounted on said housing so as to extend forwardly from said housing in the direction of said axis;

said guide bar having an elongated slot formed in said rearward end;

at least one threaded bolt fixedly mounted on said housing and extending through said elongated slot transversely to said axis when said guide bar is mounted on said housing;

a sprocket-wheel cover for covering the sprocket wheel;

threaded clamping means for threadably engaging said threaded bolt for clamping said rearward end of said guide bar between said housing and said cover;

said guide bar having a predetermined position on said housing when mounted and held on said housing;

a holding device for holding said rearward end in said predetermined position on said housing when said cover is removed;

said guide bar including two side plates and a center plate disposed therebetween; said housing having a side wall for receiving said rearward end when said guide bar is mounted on said housing; and, said holding device including a post extending from said side wall; a punching formed in said center plate so as to remain appended to said center plate; said punching being a resilient element; access openings formed in at least one of said side plates next to said resilient element so as to permit said post to engage said resilient element when said guide bar is placed on said side wall; and, latching means formed in said post for latching said resilient element when said post engages said resilient element.

22. A motor-driven chain saw defining a longitudinal axis and being equipped with a saw chain and a drive motor for driving the saw chain via a sprocket wheel, the motor-driven chain saw comprising:

a housing for accommodating the drive motor therein;

a guide bar having a guide groove for guiding the saw chain; said guide bar having a rearward end facing toward the housing where said guide bar is mounted on said housing so as to extend forwardly from said housing in the direction of said axis;

said guide bar having an elongated slot formed in said rearward end;

at least one threaded bolt fixedly mounted on said housing and extending through said elongated slot transversely to said axis when said guide bar is mounted on said housing;

a sprocket-wheel cover for covering the sprocket wheel;

threaded clamping means for threadably engaging said threaded bolt for clamping said rearward end of said guide bar between said housing and said cover;

said guide bar having a predetermined position on said housing when mounted and held on said housing;

a holding device for holding said rearward end in said predetermined position on said housing when said cover is removed;

said guide bar including two side plates and a center plate disposed therebetween;

said housing having a side wall for receiving said rearward end when said guide bar is mounted on said housing;

said motor-driven chain saw further including a tensioning device for tensioning the saw chain, said tensioning device including a set pin opening formed in said guide bar; and, a set pin extending from said side wall and through said set pin opening when said guide bar is mounted on said side wall; and, said holding device including a punching formed in said center member so as to remain appended to said center member; said punching being a resilient element; access openings formed in at least one of said side plates next to said resilient element so as to permit said set pin to engage said resilient element when said guide bar is mounted on said side wall; and, said latching means being formed in said set pin for latching said resilient element when said set pin engages said resilient element.

23. A motor-driven chain saw defining a longitudinal axis and being equipped with a saw chain and a drive motor for driving the saw chain via a sprocket wheel, the motor-driven chain saw comprising:

a housing for accommodating the drive motor therein;

a guide bar having a guide groove for guiding the saw chain; said guide bar having a rearward end facing toward the housing where said guide bar is mounted on said housing so as to extend forwardly from said housing in the direction of said axis;

said guide bar having an elongated slot formed in said rearward end;

at least one threaded bolt fixedly mounted on said housing and extending through said elongated slot transversely to said axis when said guide bar is mounted on said housing;

a sprocket-wheel cover for covering the sprocket wheel;

threaded clamping means for threadably engaging said threaded bolt for clamping said rearward end of said guide bar between said housing and said cover;

said guide bar having a predetermined position on said housing when mounted and held on said housing;

a holding device for holding said rearward end in said predetermined position on said housing when said cover is removed;

said housing having a sheet metal side wall for receiving said rearward end when said guide bar is mounted on said housing; and, said holding device including a holding tongue formed as part of said side wall; and, said holding tongue being resilient and extending in the direction of said axis and over said rearward end of said guide bar for holding said guide bar.

24. A motor-driven chain saw defining a longitudinal axis and being equipped with a saw chain and a drive motor for driving the saw chain via a sprocket wheel, the motor-driven chain saw comprising:

a housing for accommodating the drive motor therein;

a guide bar having a guide groove for guiding the saw chain; said guide bar having a rearward end facing toward the housing where said guide bar is mounted on said housing so as to extend forwardly from said housing in the direction of said axis;

said guide bar having an elongated slot formed in said rearward end;

at least one threaded bolt fixedly mounted on said housing and extending through said elongated slot transversely to said axis when said guide bar is mounted on said housing;

a sprocket-wheel cover for covering the sprocket wheel;

threaded clamping means for threadably engaging said threaded bolt for clamping said rearward end of said guide bar between said housing and said cover;

said guide bar having a predetermined position on said housing when mounted and held on said housing;

a holding device for holding said rearward end in said predetermined position on said housing when said cover is removed; and, said guide bar having an inner surface defining said elongated slot and said holding device including a peripheral groove formed in said inner surface; a latching member fixedly mounted on said housing for engaging said peripheral groove to define therewith a tongue/groove connection when said guide bar is placed on said housing; and, a receiving opening formed in said elongated slot for introducing said latching member into said peripheral groove.

25. A motor-driven chain saw defining a longitudinal axis and being equipped with a saw chain and a drive motor for driving the saw chain via a sprocket wheel, the motor-driven chain saw comprising:

a housing for accommodating the drive motor therein;

a guide bar having a guide groove for guiding the saw chain; said guide bar having a rearward end facing toward the housing where said guide bar is mounted on said housing so as to extend forwardly from said housing in the direction of said axis;

said guide bar having an elongated slot formed in said rearward end;

at least one threaded bolt fixedly mounted on said housing and extending through said elongated slot transversely to said axis when said guide bar is mounted on said housing;

a sprocket-wheel cover for covering the sprocket wheel;

threaded clamping means for threadably engaging said threaded bolt for clamping said rearward end of said guide bar between said housing and said cover;

said guide bar having a predetermined position on said housing when mounted and held on said housing;

a holding device for holding said rearward end in said predetermined position on said housing when said cover is removed; and, said holding device including a magnet mounted in said housing directly adjacent said guide bar when said guide bar is in said predetermined position.

* * * * *